US007544872B1

(12) United States Patent
Trussart

(10) Patent No.: US 7,544,872 B1
(45) Date of Patent: Jun. 9, 2009

(54) GUITARS

(76) Inventor: James Trussart, 1307 Allesandro St., Los Angeles, CA (US) 90026

( * ) Notice: Subject to any disclaimer, the term of this patent is extended or adjusted under 35 U.S.C. 154(b) by 263 days.

(21) Appl. No.: 10/446,637

(22) Filed: May 27, 2003

Related U.S. Application Data

(60) Provisional application No. 60/382,996, filed on May 24, 2002.

(51) Int. Cl.
*G10D 3/00* (2006.01)

(52) U.S. Cl. ..... 84/291

(58) Field of Classification Search ..... 84/291, 84/293, 292, 267
See application file for complete search history.

(56) References Cited

U.S. PATENT DOCUMENTS

| | | | | | |
|---|---|---|---|---|---|
| 2,045,265 | A * | 6/1936 | Dopyera | ..... | 84/292 |
| 4,201,108 | A * | 5/1980 | Bunker | ..... | 84/743 |
| 4,829,870 | A * | 5/1989 | Ralston | ..... | 84/291 |
| 4,840,102 | A * | 6/1989 | Pittman | ..... | 84/293 |
| 5,549,026 | A * | 8/1996 | Gay, Jr. | ..... | 84/292 |
| 6,233,825 | B1 | 5/2001 | DeGroot | | |
| D445,444 | S | 7/2001 | Wilson | | |
| 6,255,567 | B1 * | 7/2001 | Minakuchi | ..... | 84/291 |
| 2001/0052281 | A1 * | 12/2001 | Minakuchi | ..... | 84/291 |
| 2004/0134334 | A1 * | 7/2004 | Baggs | ..... | 84/723 |

FOREIGN PATENT DOCUMENTS

| | | | |
|---|---|---|---|
| SU | 1660031 | * | 6/1991 |

* cited by examiner

*Primary Examiner*—Kimberly R Lockett
(74) *Attorney, Agent, or Firm*—Garvey, Smith, Nehrbass & North, L.L.C.; Seth M. Nehrbass

(57) ABSTRACT

A guitar or guitar-like instrument includes a wooden neck and a body made of metal, the body being substantially hollow and having a plurality of holes therein. There are at least 10 holes in the body. A guitar or guitar-like instrument can include a neck of wood, a body of wood, and metal inlaid into the wood. The metal is inlaid into the wood in the body and/or the metal is inlaid into the wood in the neck.

14 Claims, 15 Drawing Sheets

GUITARS

CROSS-REFERENCE TO RELATED APPLICATIONS

Priority of my U.S. Provisional Patent Application Ser. No. 60/382,996, filed 24 May 2002, incorporated herein by reference, is hereby claimed.

BACKGROUND OF THE INVENTION

1. Field of the Invention

The present invention relates to guitars. More particularly, the present invention relates to metal and wood guitars.

2. General Background of the Invention

Traditional acoustic guitars have hollow wooden bodies. Traditional electric guitars have solid wooden bodies.

The following U.S. Patents are incorporated herein by reference:

U.S. Pat. No. 6,255,567 Stringed musical instrument with composite body partially formed of metal or synthetic resin;

U.S. Pat. No. 6,233,825 Metallic stringed musical instrument body and method of making said body.

BRIEF SUMMARY OF THE INVENTION

The apparatus of the present invention includes a guitar or guitar-like instrument comprising a wooden neck and a body made of metal, the body being substantially hollow and having a plurality of holes therein. There are at least 10 holes in this body. The holes can be in the top face of the body and/or in the back of the body. In some embodiments the holes are in the top face and the neck of the body. In some embodiments, there is a wood headstock with metal inlayed into the wood in the headstock.

The apparatus of the present invention also includes a guitar or guitar-like instrument comprising a neck comprising wood, a body comprising wood, and metal inlaid into the wood. The metal is inlaid into the wood in the body and/or the metal is inlaid into the wood in the neck.

There can be cavities in the solid wood part of the electric guitar, and recessed metal in the wood part of the body of the guitar.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals donate like elements and wherein.

DETAILED DESCRIPTION OF THE INVENTION

Figure 1:
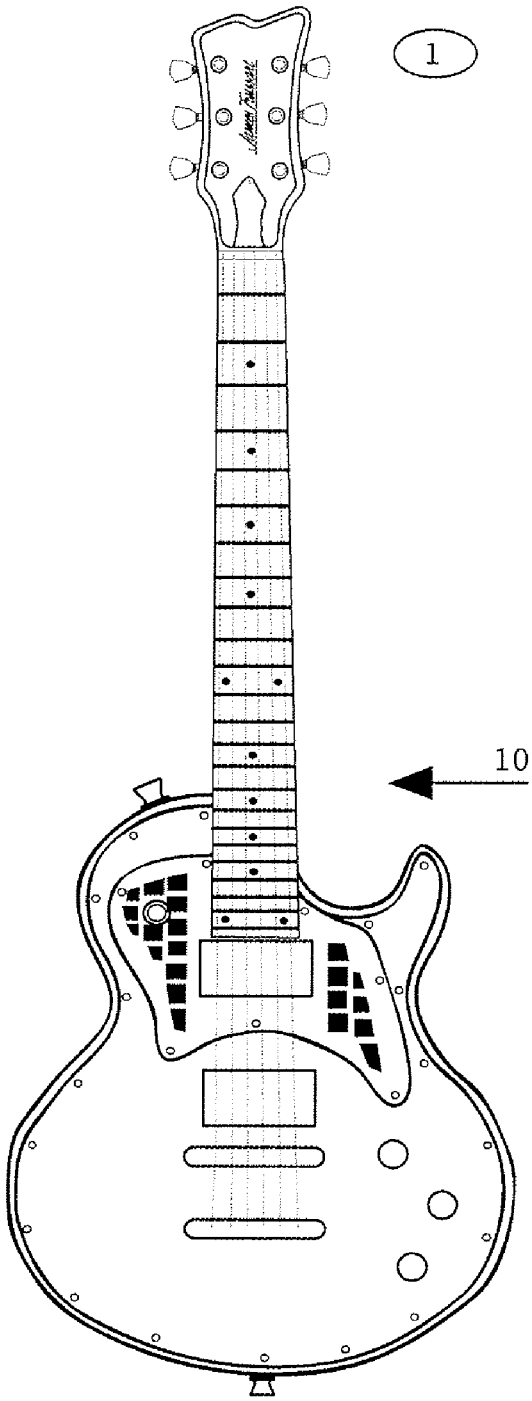
FIG. 1 is a front view of a first embodiment of the present invention.
Figure 2:
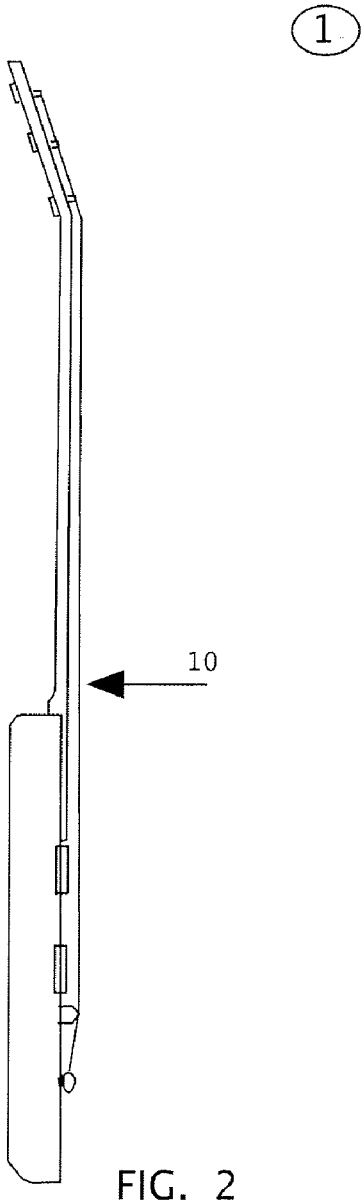
FIG. 2 is a side view of the guitar of FIG. 1.
Figure 3:
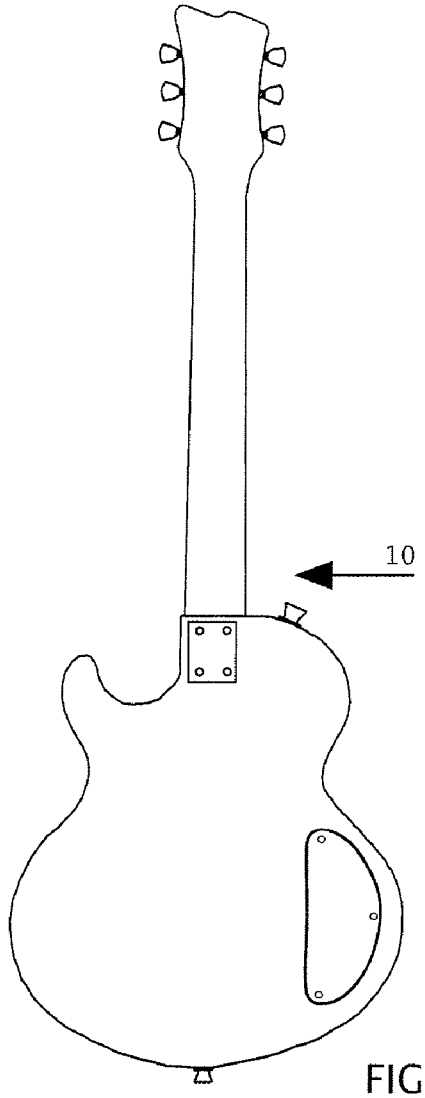
FIG. 3 is a rear view of the guitar of FIG. 1.

FIGS. 1-3 show the James Trussart design of a "Steel Top", a guitar 10 made of wood with a metal plate inlayed on top. The metal to make guitar 10 can be, for example, steel, Stainless steel or Aluminum. The wood can be mahogany, koa, Wenge, or swamp ash or alder, for example.

Figure 4:
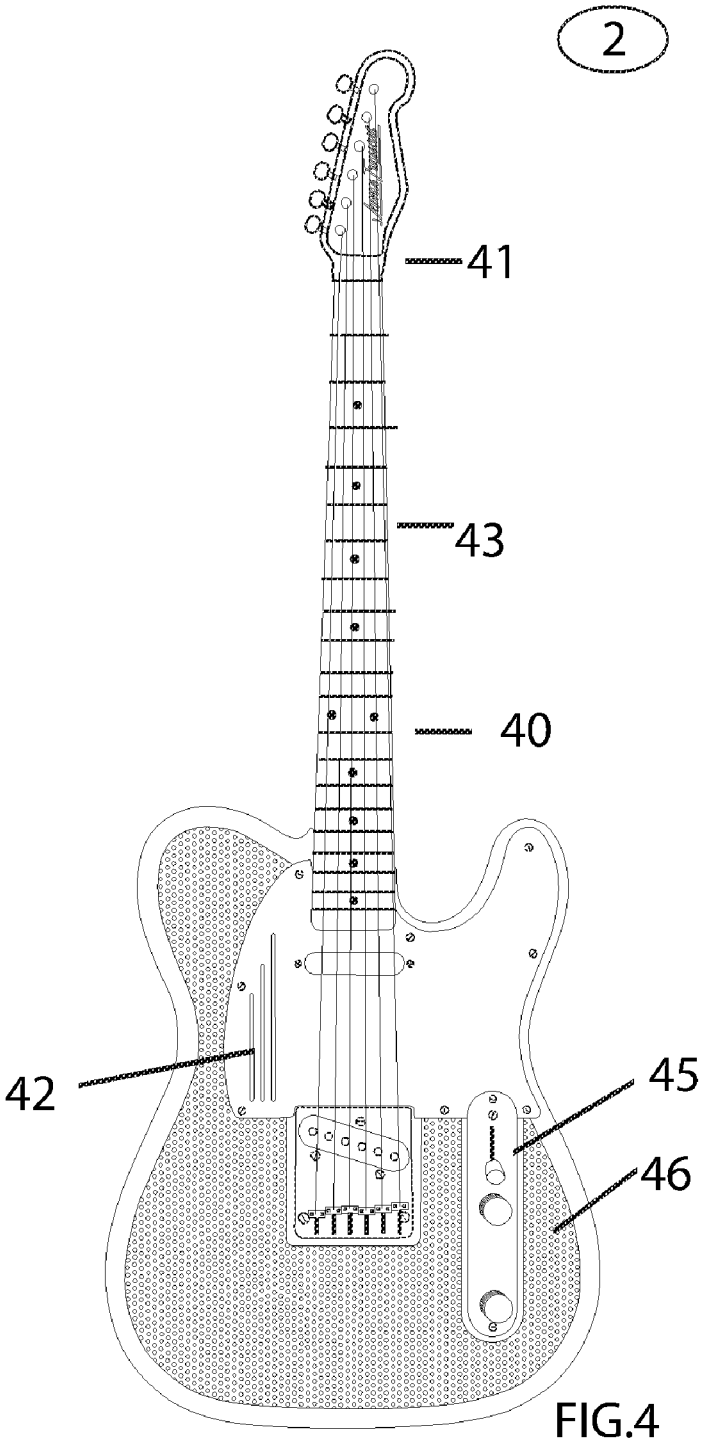
FIG. 4 is a front view of a second embodiment of the present invention.
Figure 5:
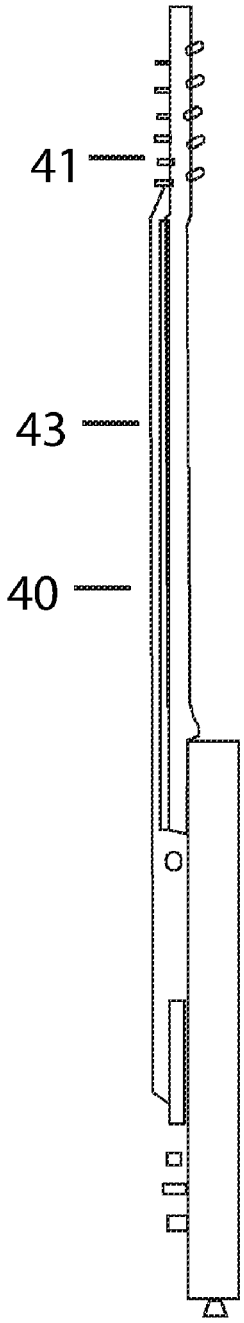
FIG. 5 is a side view of the guitar of FIG. 4.
Figure 6:
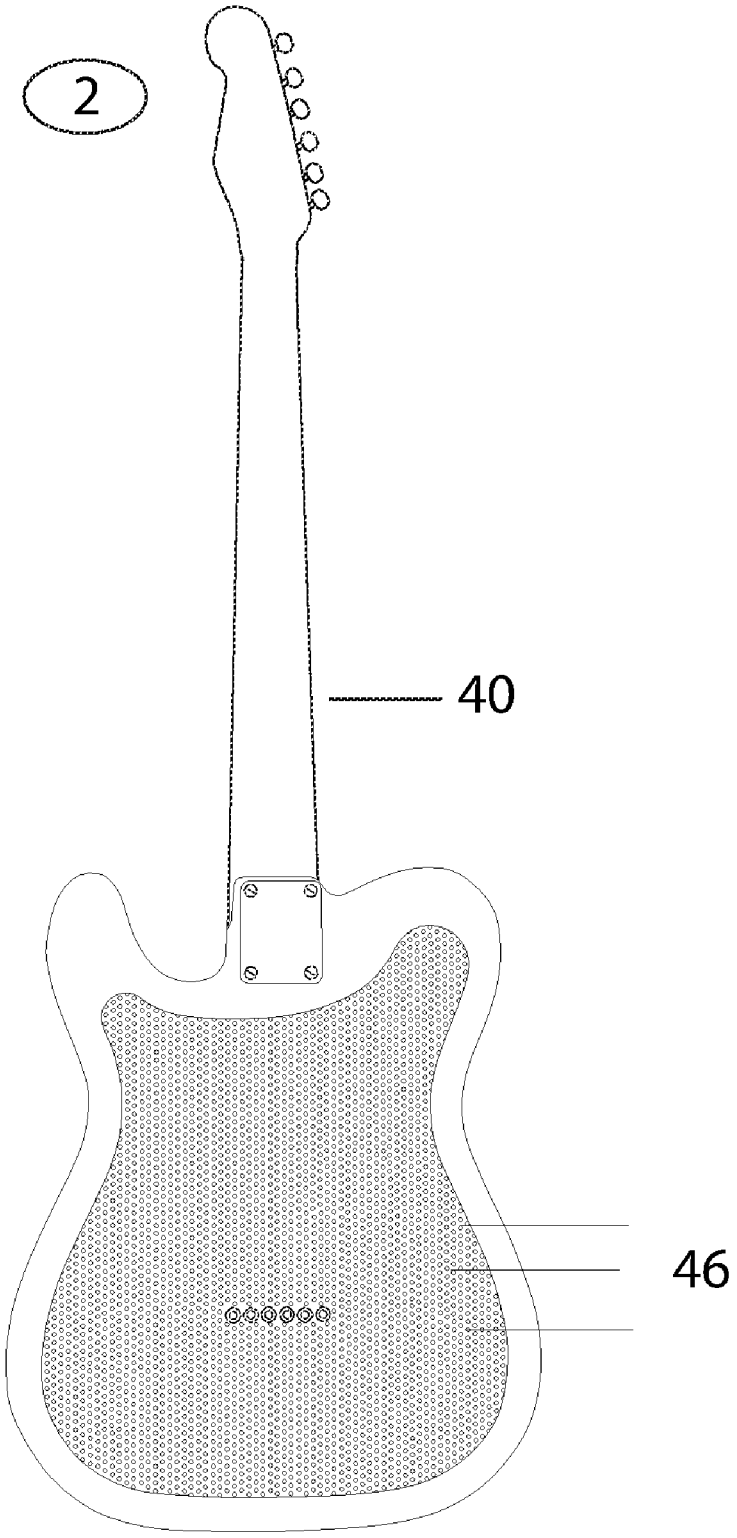
FIG. 6 is a rear view of the guitar of FIG. 4.

FIGS. 4-6 show the James Trussart design of a "Steelcaster", a guitar 40 made entirely of metal (with a wooden neck 43), with a cut out 45 and holes 46; it includes an ornamental head stock 41 and distinctive three lines 42. The metal to make guitar 40 can be, for example, steel, stainless steel, or aluminum. The wood for the neck can be koa or maple for example. Holes 46 affect the sound made by guitar 40 by making the guitar lighter and also makes this electric guitar less subject to feedback.

Figure 7:
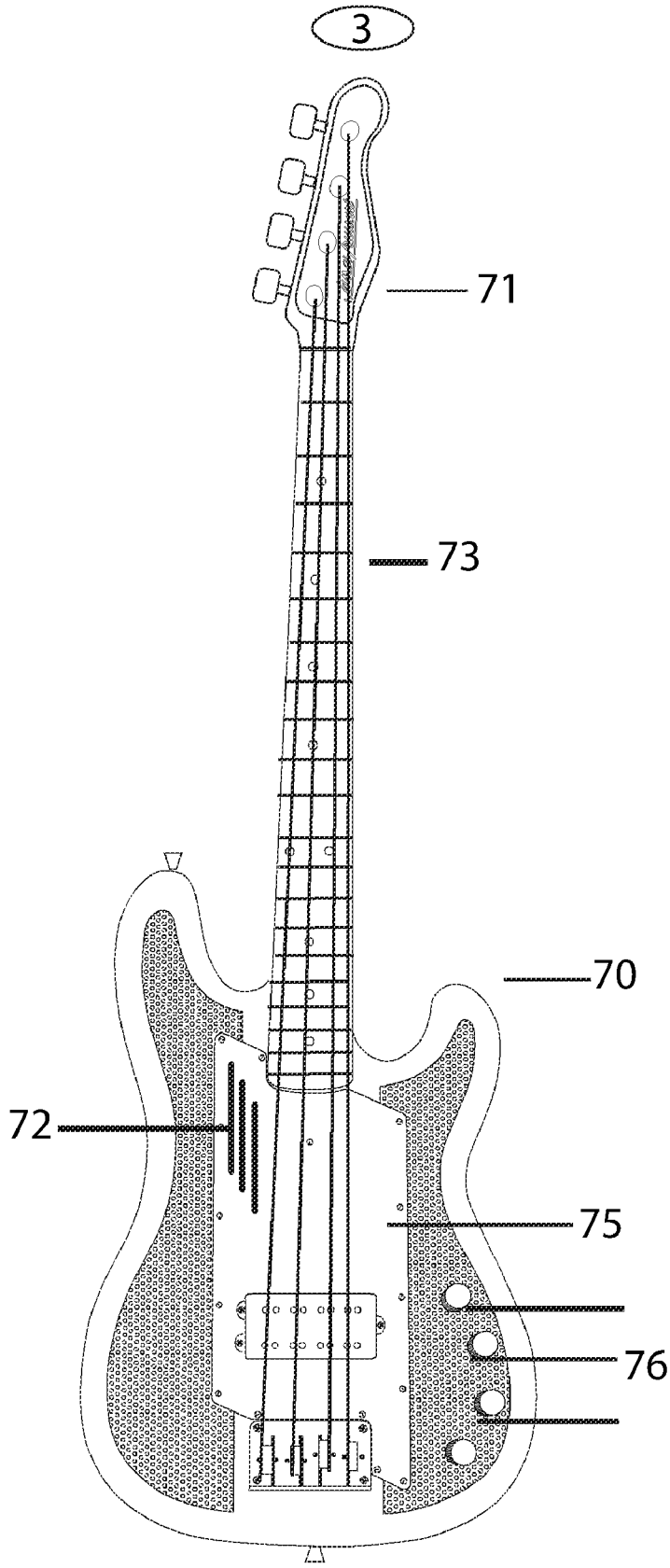
FIG. 7 is a front view of a third embodiment of the present invention.
Figure 9:
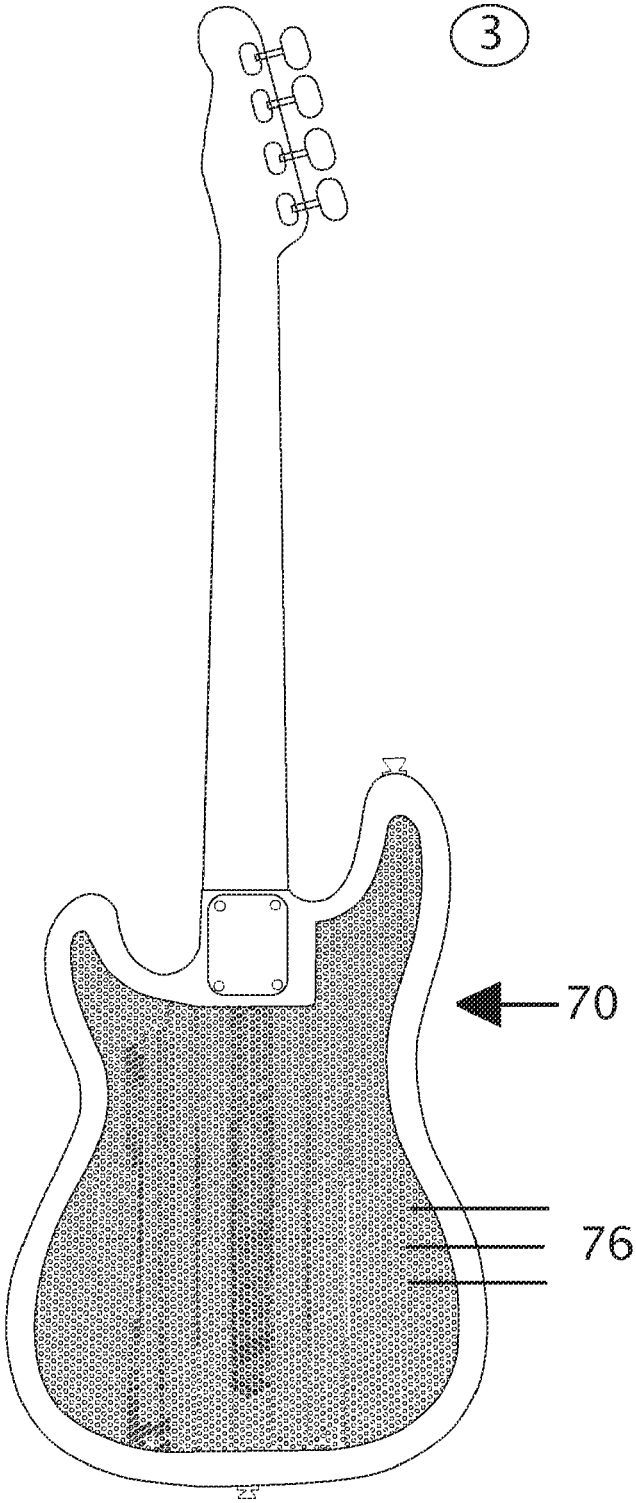
FIG. 9 is a rear view of the guitar of FIG. 7.
Figure 8:
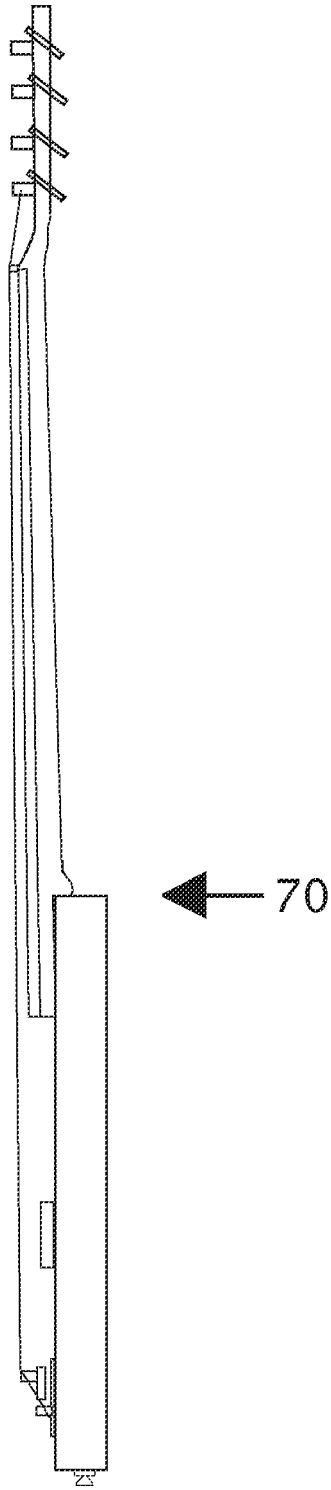
FIG. 8 is a side view of the guitar of FIG. 7.

FIGS. 7-9 show the James Trussart design of a "Steelcaster Bass", a guitar 70 made entirely of metal (with a wooden neck 73), with a cut out 75 and holes 76; it includes an ornamental head stock 71 and distinctive three lines 72. The metal to make guitar 70 can be, for example, steel, aluminum, stainless steel, or brass. The wood for the neck can be maple/rosewood, or koa Ebony, for example. The purpose of holes 76 is the same as that of holes 46.

Figure 10:
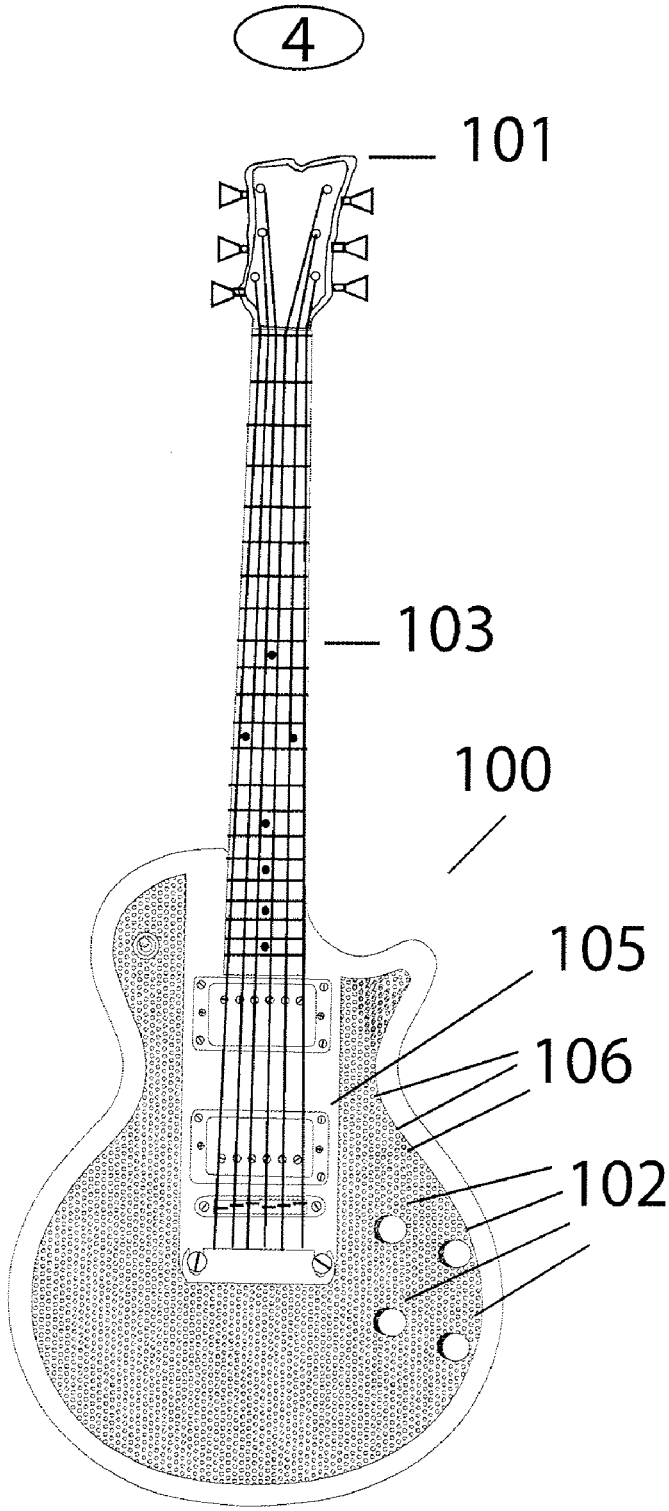
FIG. 10 is a front view of a fourth embodiment of the present invention.
Figure 11:
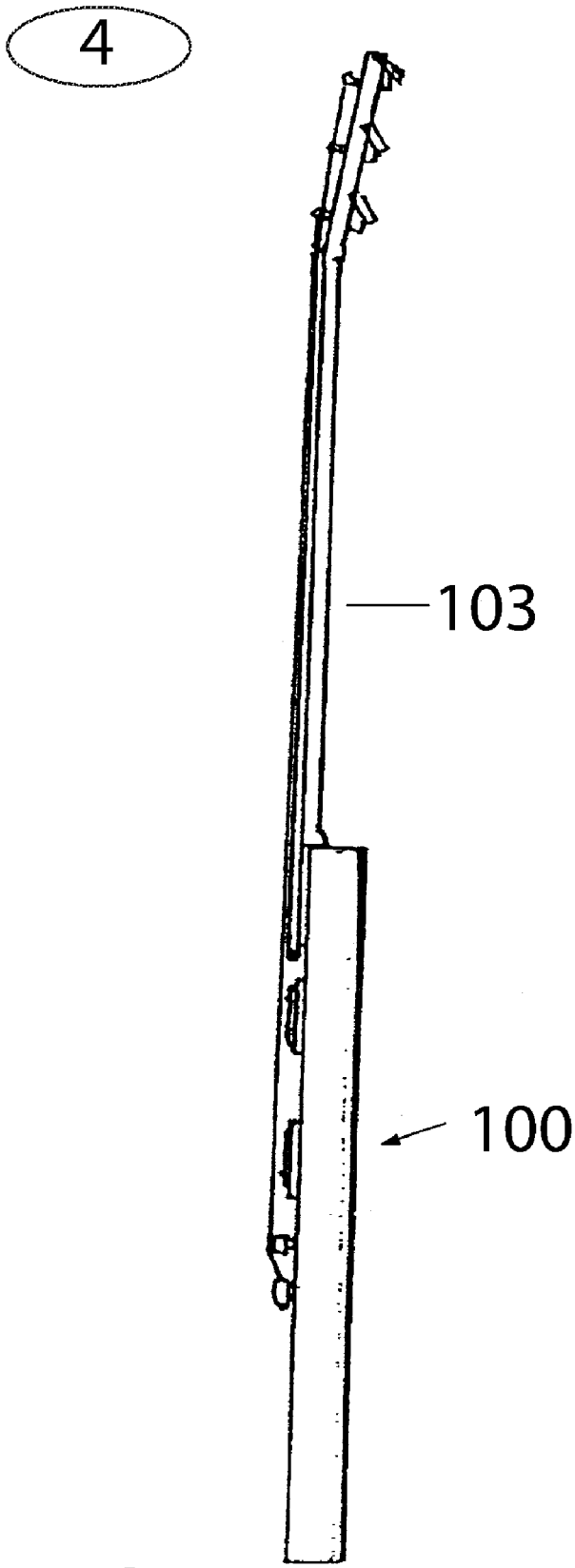
FIG. 11 is a side view of the guitar of FIG. 10.
Figure 12:
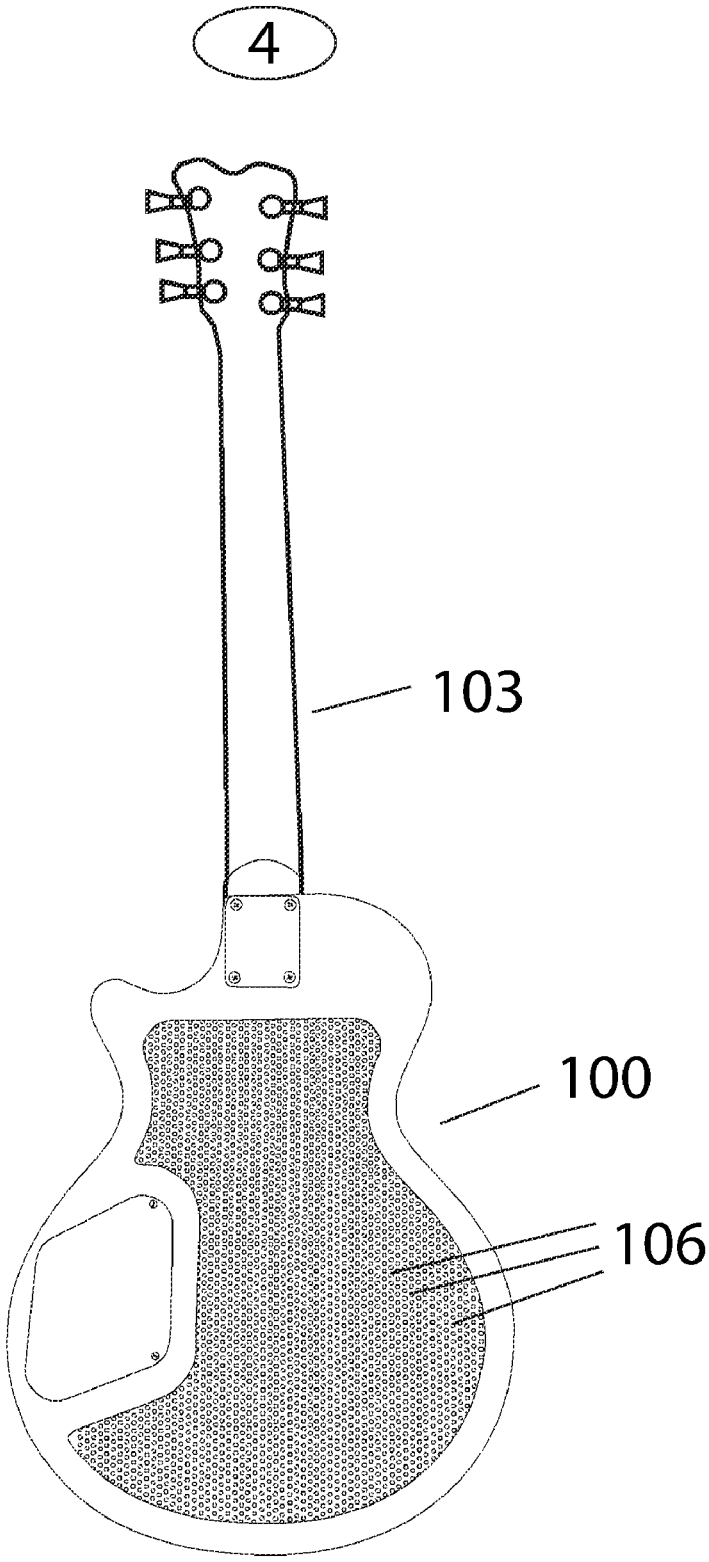
FIG. 12 is a rear view of the guitar of FIG. 10.

FIGS. 10-12 show the James Trussart design of a "Steel Deville", a guitar 100 made entirely of metal (with a wooden neck 103), with a cut out 105 and holes 106; it includes an ornamental head stock 101 and distinctive four holes 102. The metal to make guitar 100 can be, for example, steel, aluminum, stainless steel, or brass. The wood for the neck can be maple/rosewood, or koa Ebony, for example. The purpose of holes 106 is the same as that of holes 46.

Figure 13:
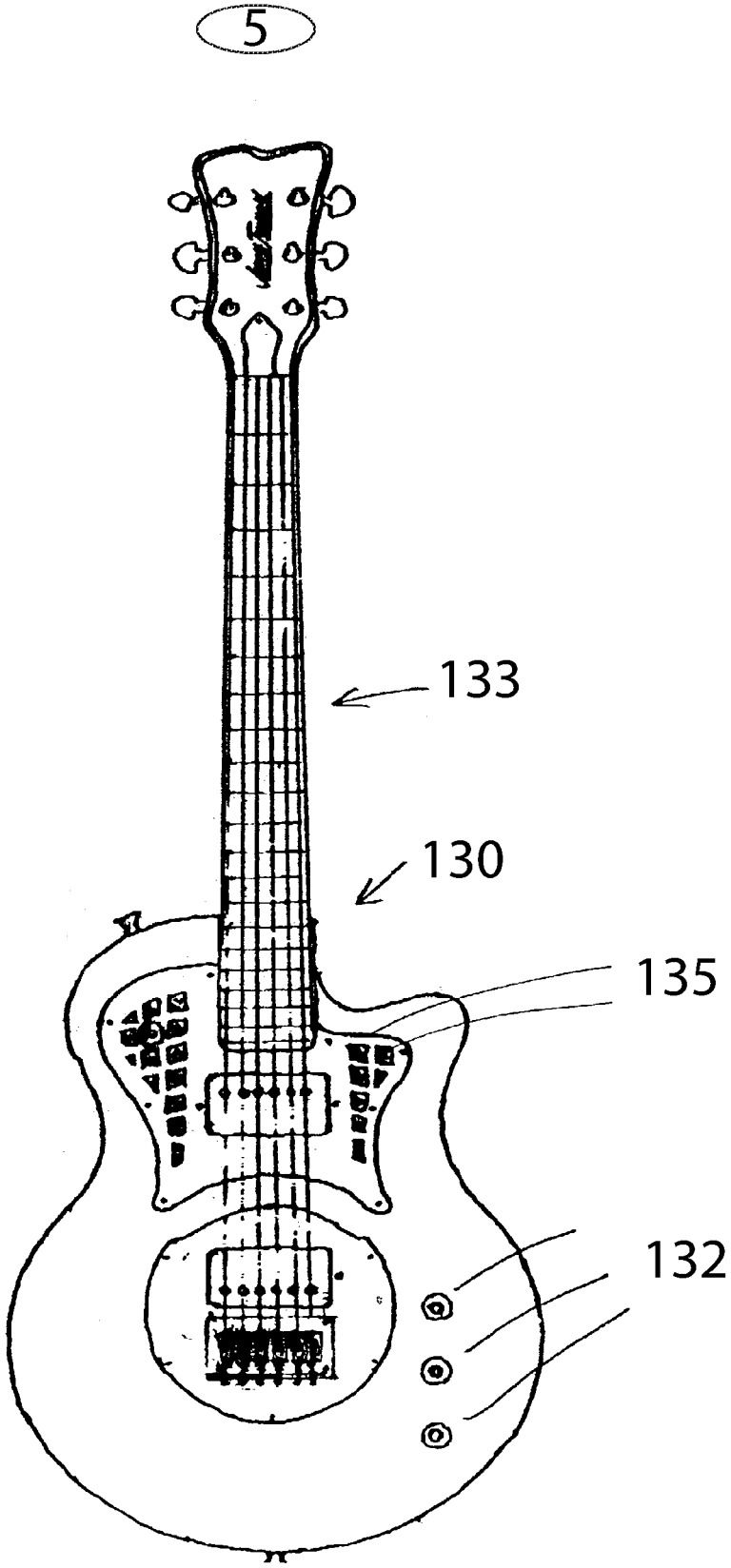
FIG. 13 is a front view of a fifth embodiment of the present invention.
Figure 14:
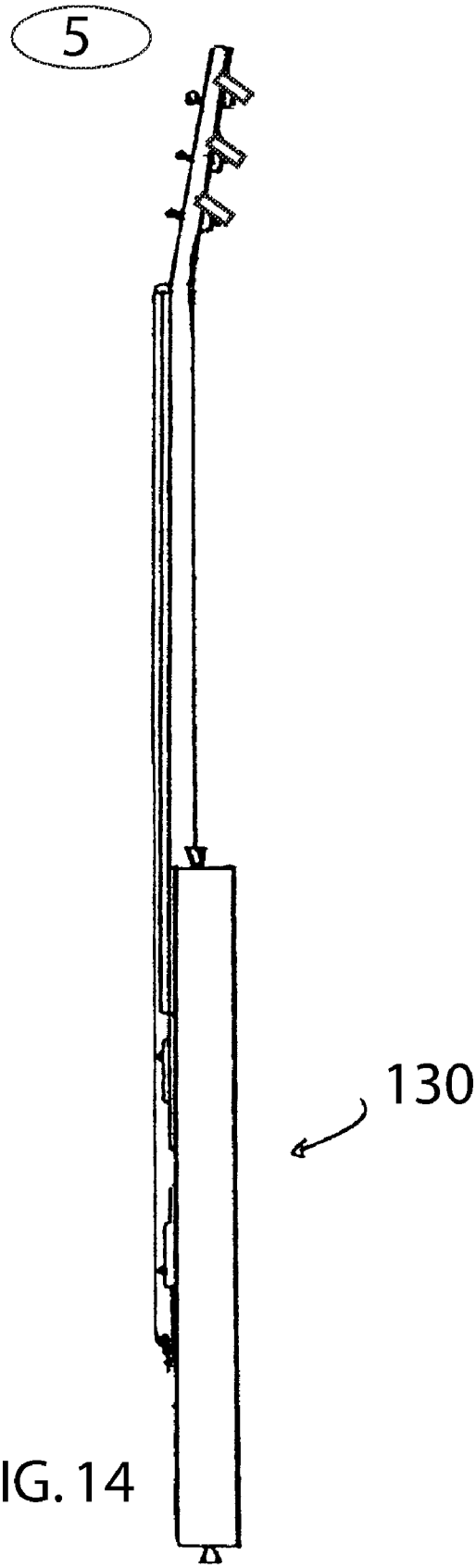
FIG. 14 is a side view of the guitar of FIG. 13.
Figure 15:
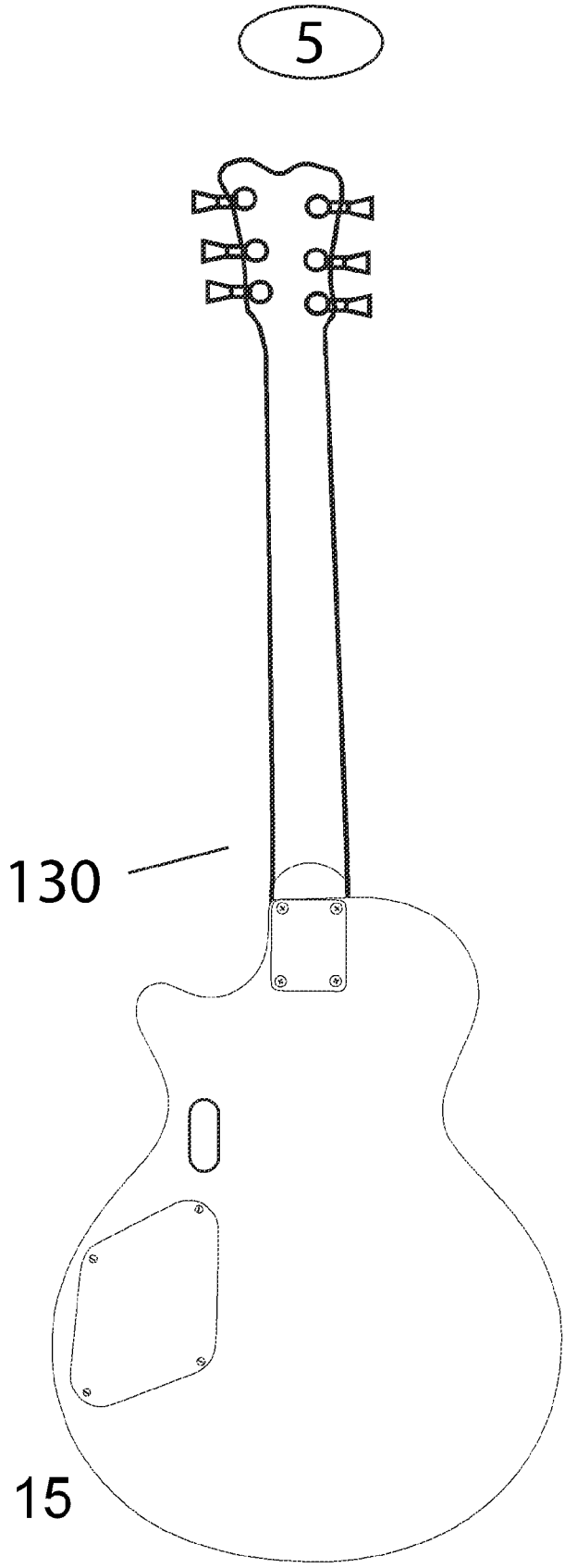
FIG. 15 is a rear view of the guitar of FIG. 13.

FIGS. 13-15 is a front view of the James Trussart design of a "Steelphonic", a guitar 130 made entirely of metal (with a wooden neck 133), with a cut out 135; it includes distinctive three circles 132. The metal to make guitar 130 can be, for example, steel, aluminum, stainless steel, or brass. The wood for the neck can be maple/rosewood, or koa Ebony, for example.

As can be seen in FIGS. 4-15, the front faces and the backs of the guitars are flat. In some embodiments the holes are in the top faces and the backs of the body. In some embodiments, there is a wood headstock with metal inlayed into the wood in the headstock.

As can be seen in FIGS. 4, 6, 7, 9, 10, 12, the holes 46, 76, 106 are unfilled.

Figure 16:
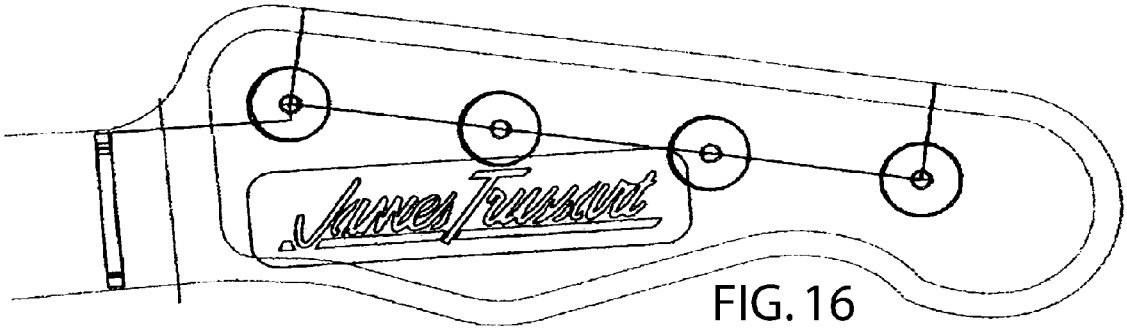
FIG. 16 is a modified Steelcaster Bass headstock contour with matching recessed metal headplate.
Figure 17:
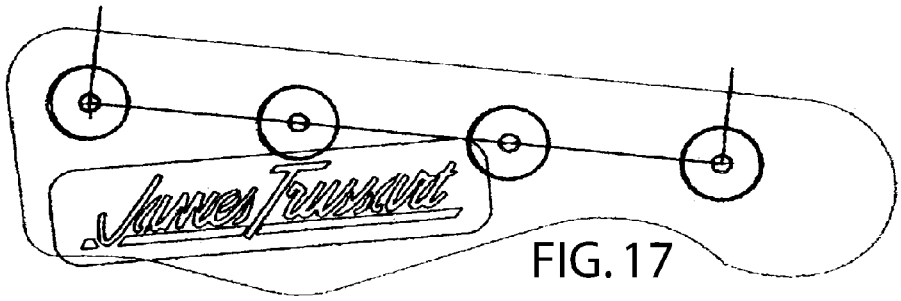
FIG. 17 is the headplate in FIG. 16.
Figure 18:
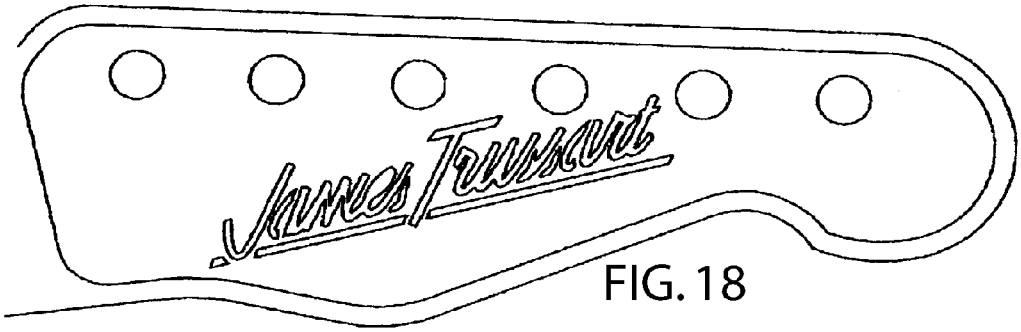
FIG. 18 is a modified Steelcaster headstock contour with matching recessed metal headplate.
Figure 19:
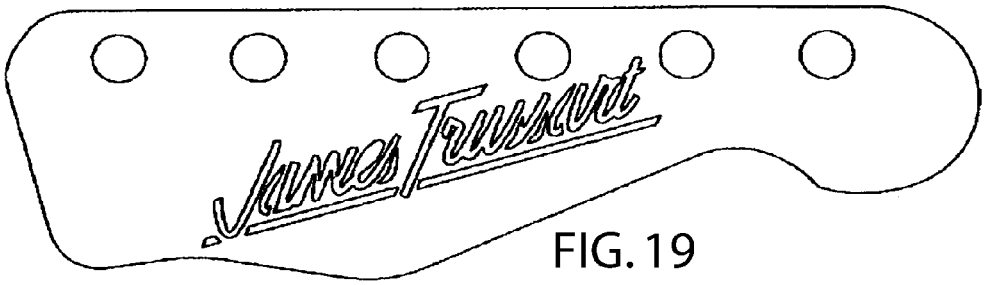
FIG. 19 is the headplate in FIG. 18.

FIG. 16 shows a modified Steelcaster Bass wooden headstock contour with matching recessed metal headplate. FIG. 17 is the metal headplate shown also in FIG. 16. FIG. 18 shows a modified Steelcaster wooden headstock contour with matching recessed metal headplate. FIG. 19 shows the headplate also seen in FIG. 18.

Figure 20:
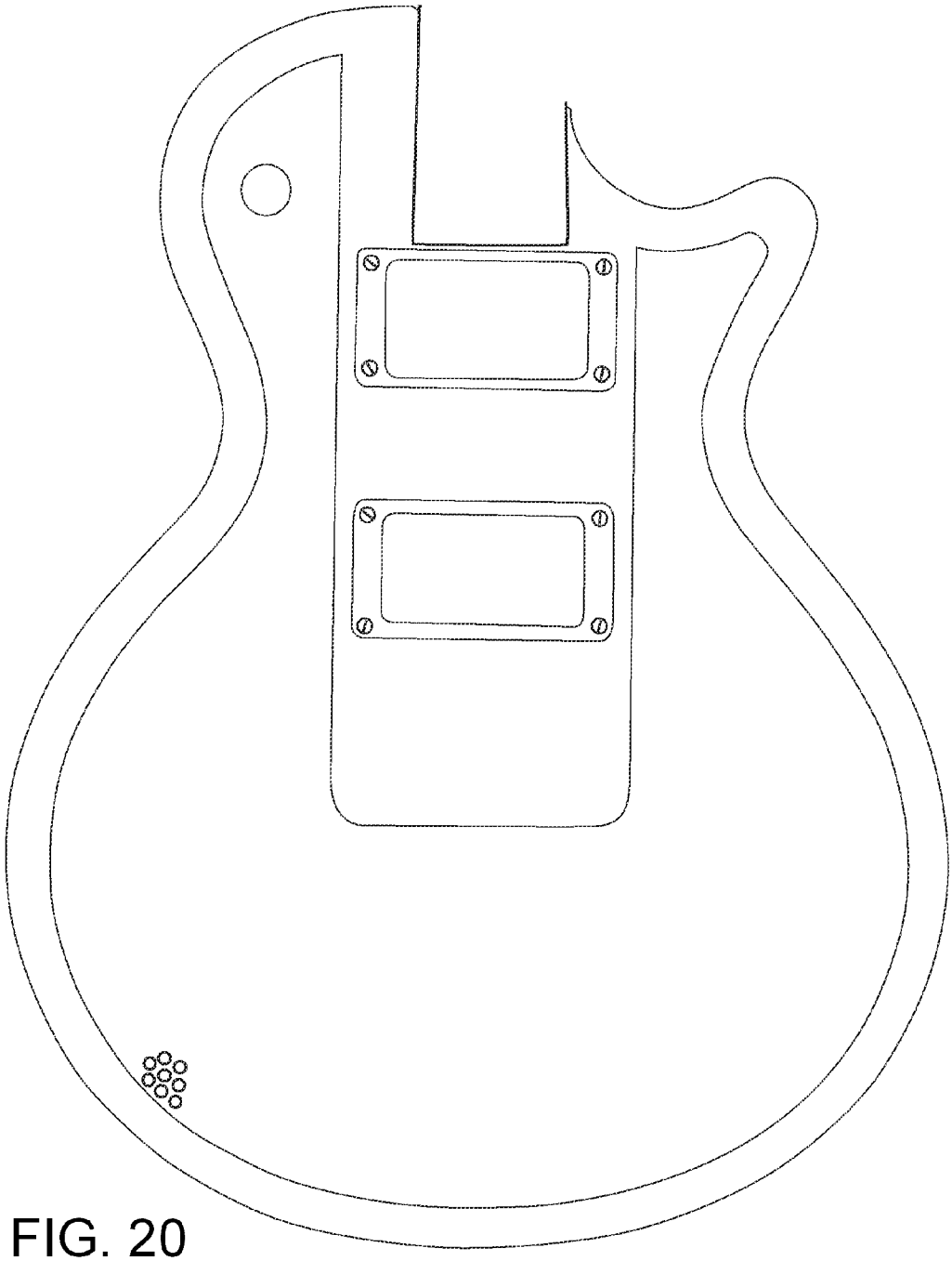
FIG. 20 is a modified Steel Deville body contour including or not a Holey top and Holey back.
Figure 21A:
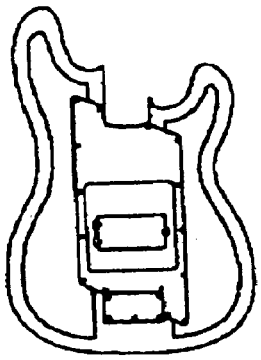
FIGS. 21A-21E show a modified design of the holey SteelcasterBass back (access back).
Figure 21B:
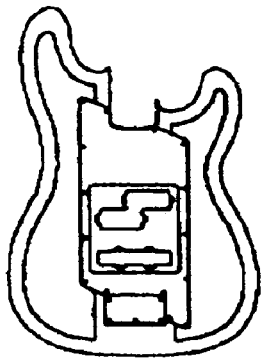
Figure 21C:
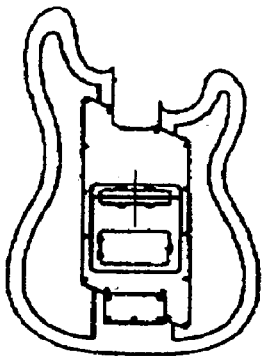
Figure 21D:
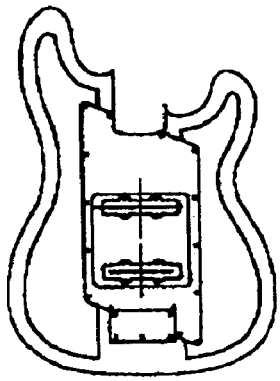
Figure 21E:
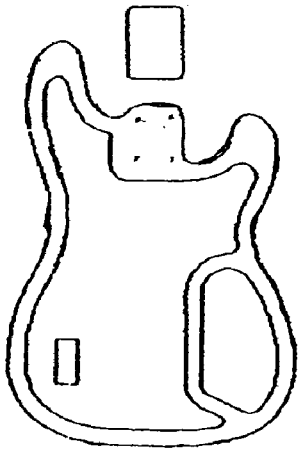

FIG. 20 shows a modified Steel Deville body contour including or not a holey top and holey back. FIGS. 21A-21E show a modified design of the holey Steelcaster Bass back (access back).

Additional information about the guitar of the present invention can be found in the pages attached to my U.S. Provisional Patent Application Ser. No. 60/382,996, filed 24 May 2002.

PARTS LIST

The following is a list of parts and materials suitable for use in the present invention:

10 guitar of a first embodiment of the present invention
40 guitar of a second embodiment of the present invention
43 neck (preferably made of wood)
45 cut out
46 holes
41 ornamental head stock
42 distinctive three lines
70 guitar made entirely of metal
71 ornamental head stock
72 distinctive three lines
73 wooden neck
75 cut out
76 holes
100 guitar made entirely of metal
101 ornamental head stock
102 distinctive four holes
103 wooden neck
105 cut out
106 holes
130 guitar made entirely of metal
132 distinctive three circles
133 wooden neck
135 cut out All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. Apparatus including an electric guitar comprising:
a neck;
a body made of metal, the body being substantially hollow and having a plurality of unfilled holes therein, wherein the body has a flat top face and a flat back, and wherein there are at least 10 holes in the flat top face and/or the flat back of the body.

2. The apparatus of claim 1, wherein the holes are in the top face and the back of the body.

3. The apparatus of claim 1, wherein the holes are in the top face of the body.

4. The apparatus of claim 1, wherein the holes are in the back of the body.

5. The apparatus of claim 1, wherein the electric guitar includes a wooden headstock, and metal is inlaid into the wood in the headstock.

6. The apparatus of claim 1, wherein the neck comprises wood.

7. Apparatus including an electric guitar comprising:
a neck;
a body made of metal, the body being substantially hollow, having a flat top face and a flat back, and having a plurality of at least 10 unfilled holes in the flat top face and the flat back on the body.

8. The apparatus of claim 7, wherein the guitar or guitar-like instrument includes a wooden headstock, and metal is inlaid into the wood in the headstock.

9. The apparatus of claim 7, wherein the neck comprises wood.

10. Apparatus including an electric guitar comprising:
a neck;
a body having a plurality of at least unfilled 10 holes therein, wherein the body has a flat top face and a flat back, and the at least unfilled 10 holes are in the flat top face and/or the flat back of the body, and wherein the electric guitar includes a wooden headstock, and metal is inlaid into the wood in the headstock.

11. The apparatus of claim 10, wherein the body includes metal.

12. The apparatus of claim 11, wherein the body is substantially hollow.

13. The apparatus of claim 10, wherein the body is substantially hollow.

14. The apparatus of claim 10 wherein the neck comprises wood.

* * * * *